United States Patent [19]

Sartoni

[11] Patent Number: 4,657,031

[45] Date of Patent: Apr. 14, 1987

[54] CUT TOBACCO DISTRIBUTING DEVICE FOR CIGARETTE MAKING MACHINES

[75] Inventor: Massimo Sartoni, Bologna, Italy

[73] Assignee: Sasib S.p.A., Bologna, Italy

[21] Appl. No.: 756,699

[22] Filed: Jul. 18, 1985

[30] Foreign Application Priority Data

Jul. 27, 1984 [IT] Italy ..... 12572 A/84

[51] Int. Cl.[4] ..... A24C 5/39

[52] U.S. Cl. ..... 131/109.1; 131/108; 19/97; 19/114

[58] Field of Search ..... 131/108, 109.1; 19/97, 19/114

[56] References Cited

U.S. PATENT DOCUMENTS

| | | | |
|---|---|---|---|
| 458,229 | 8/1891 | Emerson | 19/97 |
| 4,172,515 | 10/1979 | Wochnowski | 131/108 |
| 4,442,848 | 4/1984 | Seragnoli | 131/108 |
| 4,510,949 | 4/1985 | Preston et al. | 131/108 |
| 4,570,644 | 2/1986 | Ahern et al. | 131/108 |

*Primary Examiner*—Mullin V.
*Assistant Examiner*—H. Macey
*Attorney, Agent, or Firm*—Spencer & Frank

[57] ABSTRACT

The invention has for its object a cut-tobacco distributing device for cigarette making machines.

The distributing device includes a rotating drum (2) provided with points (3) which takes or receives the cut tobacco.

The drum (2) provided with points (3) cooperates with a rotating detaching cylinder (18) which takes the cut tobacco from the said drum (2).

According to the invention, in order to reduce the mechanical stresses which exert a degrading action on the cut tobacco, the points (3) of the drum (2) are retractable inside the drum (2) itself and are controlled by cams (8, 9) which retract them, temporarily, in a complete or almost complete way in the region of the detaching cylinder (18).

The latter is constructed as a pneumatic suction cylinder without points.

12 Claims, 3 Drawing Figures

CUT TOBACCO DISTRIBUTING DEVICE FOR CIGARETTE MAKING MACHINES

BACKGROUND AND SUMMARY OF THE INVENTION

The invention relates to a distributing device for cut tobacco, to be used in cigarette making machines, which includes a pointed rotating drum which takes or receives the cut tobacco, and a pointed detaching roller which cooperates with said drum and detaches the cut tobacco from same.

The pointed drum can take the cut tobacco from a bulky mass of tobacco contained in a box. In this case the pointed drum cooperates also with a pointed equalizer drum, rotating and preferably with a shorter diamater, and which removes the excess of tobacco taken by the drum, leaving, attached to the points of the latter, only a thin layer of cut tobacco, constant in thickness, and which is then removed from the drum by the action of the detaching cylinder.

The pointed drum can, however, receive the cut tobacco, already previously spread and carded which is fed from the top into a vertical duct, wherein a column of tobacco is formed. This tobacco is taken by the pointed drum, in the form of a uniform and thin veil, at the basis of the said vertical duct, and it is then removed from the drum by the detaching roller.

In the cut tobacco distributing devices of the known previous art, the rotating detaching roller is also provided with points and, therefore, it exerts a mechanical action on the tobacco, which damages the tobacco itself and determines a substantial degradation of same.

The invention has the purpose of eliminating this inconvenience and of ensuring a much more delicate treatment of the cut tobacco.

This purpose is achieved by the invention through the fact that the points of the drum are retractable inside the drum itself and are controlled by means which retract the same temporarily in a complete or almost complete manner in the region of the detaching cylinder, which is constructed as a smooth (without points) pneumatic suction cylinder. In this way the cut tobacco kept in the points of the drum is released by the complete and temporary retraction of such points in the region of the detaching cylinder which removes the tobacco from the drum by simple suction, without any sensible resistance and practically with no mechanical damage. Subsequently the points of the drum are caused to protrude again, to take or receive again a layer, or veil, of cut tobacco.

According to one embodiment of the invention the means which control the travel of the retractable points in the drum are adjustable in such a way as to make it possible to vary the degree of projection of the points from the body of the drum, in order to vary the quantity of cut tobacco taken or received in the time unit, by the pointed drum itself.

BRIEF DESCRIPTION OF THE DRAWINGS

These and other characteristics of the invention and the consequent advantages, appear from the following description of a preferred embodiment, described just for exemplification purposes and not as a binding example, in the attached drawings, wherein.

DESCRIPTION OF THE PREFERRED EMBODIMENT

With reference to the figures, the cut-tobacco distributing device for cigarette-making machine, includes a pointed drum 2 arranged in correspondence with the lower outlet of a vertical duct or bin 1, which is fed, from top, with the cut tobacco spread and/or carded. Drum 2 rotates in the direction of arrow F and is constructed with retractable points 3.

Figure 1:
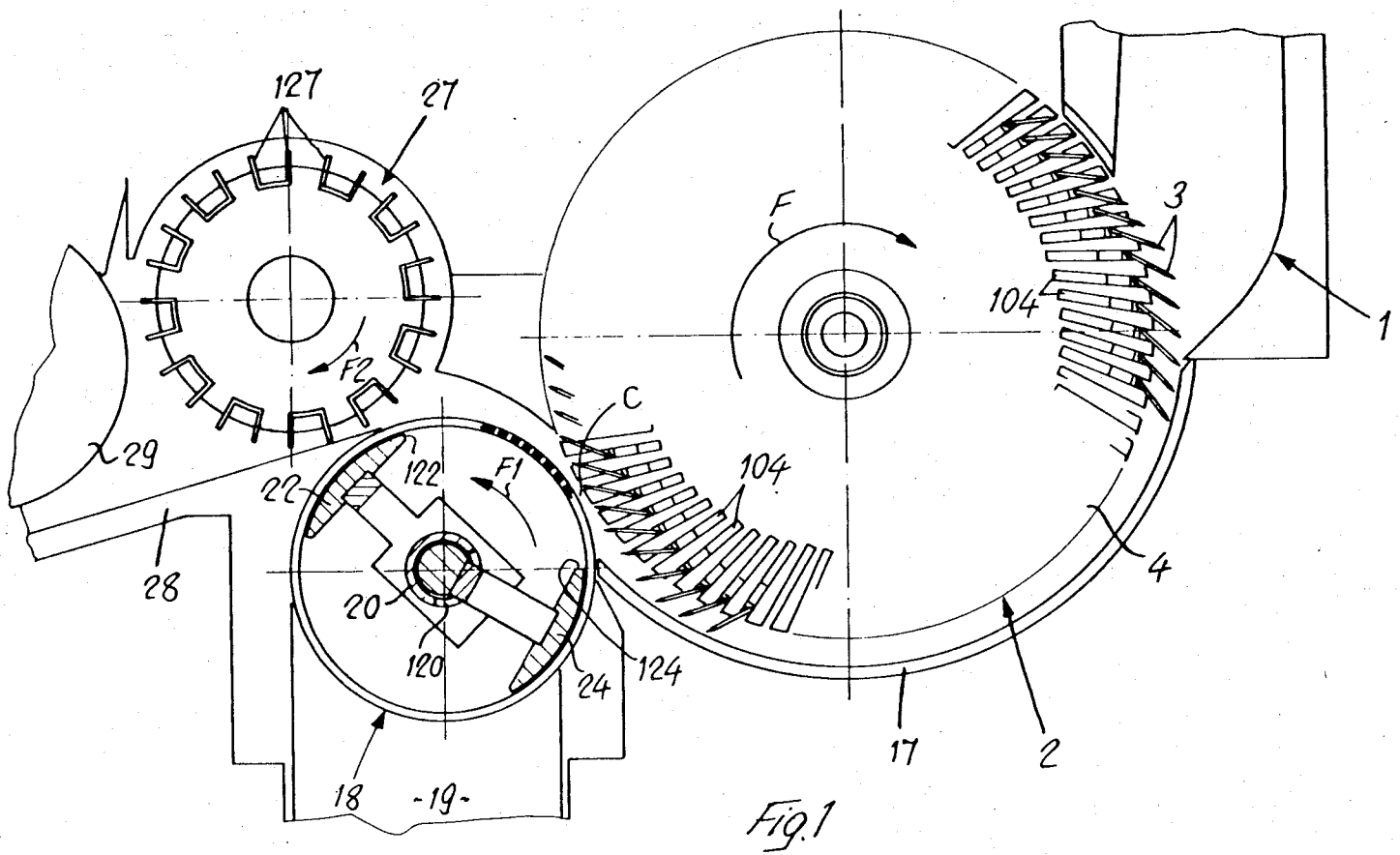
FIG. 1 is a cross section schematic view of a cut-tobacco distributing device, according to the invention.

From the constructive point of view the retractability of points 3 can be obtained through any suitable system. In the illustrated executive example, drum 2 is formed by two flanges 4 keyed on a tubular shaft 5 and provided, peripherally, with slots 104 angularly equispaced and radially directed or preferably inclined with respect to the radial direction, as it results, for example, from FIG. 1.

The tubular shaft 5 is mounted, revolving through bearings 105, in the drum holding frame 31, and it can be driven, for instance, through the gear wheel 32.

The points 3 of drum 2 are fixed on points carrying bars 6. The extremities 106 of each points-carrying bar 6 slide in two peripheral aligned slots 104 of the two head flanges 4.

Every flange 4 has also, peripherally, a circumferential slot 7 which houses an annular spring 107 which encompasses the extremities 106 of the points-carrying bars and presses them inward.

Figure 3:
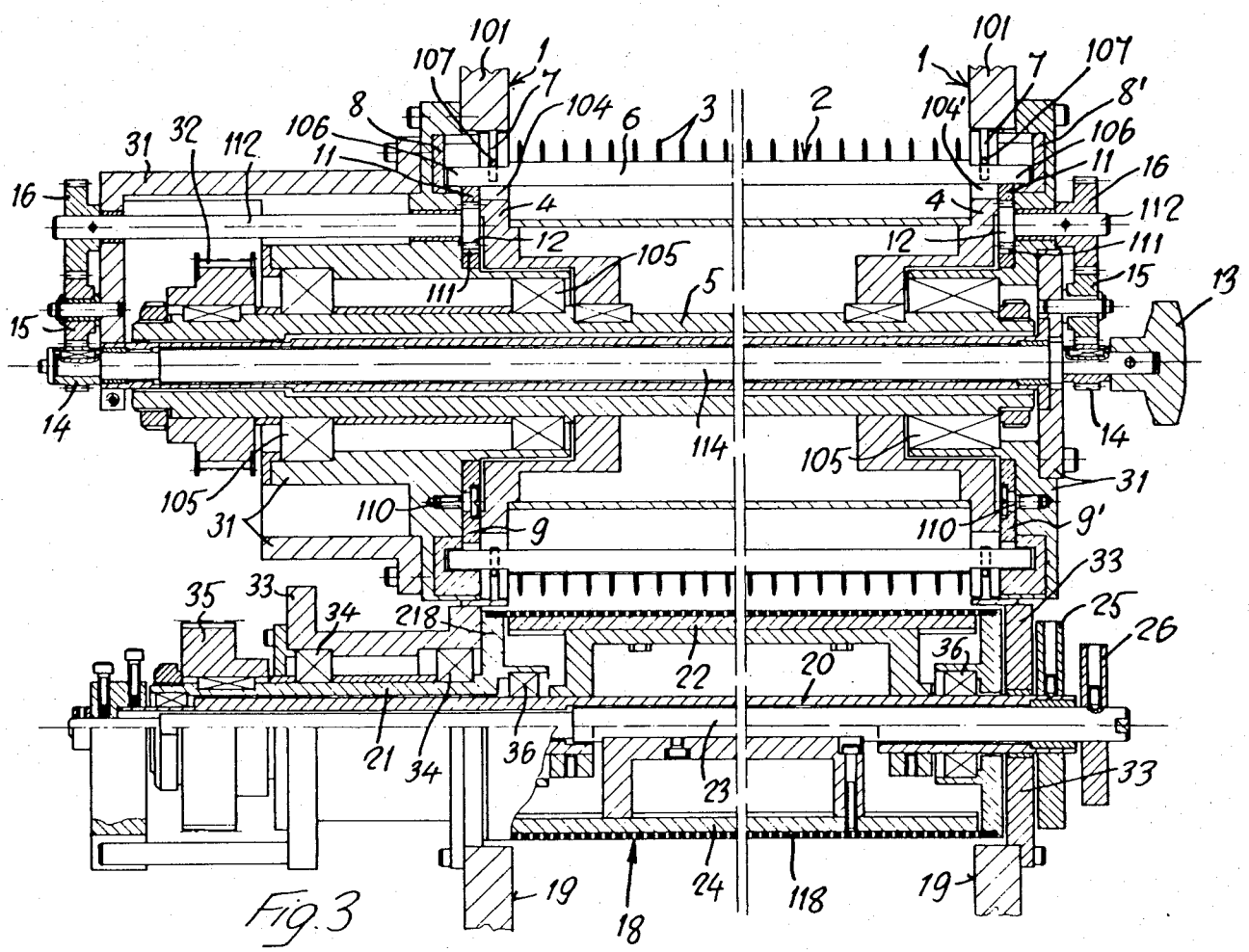
FIG. 3 is an axial section of the retractable points drum and of the respective suction detaching drum.

The point-carrying bars 6 can therefore move each one in its respective pair of peripheral slots 104 of the two flanges 4, between two terminal positions in one of which the respective points 3 project, to their maximum extent, from the peripheral surface of drum 2, defined, for instance, by the peripheral surfaces of the two flanges 4, while in the other position points 3 are completely retracted in the peripheral surface of drum 2, as shown in detail in FIG. 3.

Obviously instead of the annular springs 107 common to all point-carrying bars 6 each of these point-carrying bars 6 can be urged inward by associated individual springs acting on its extremities 106.

Figure 2:
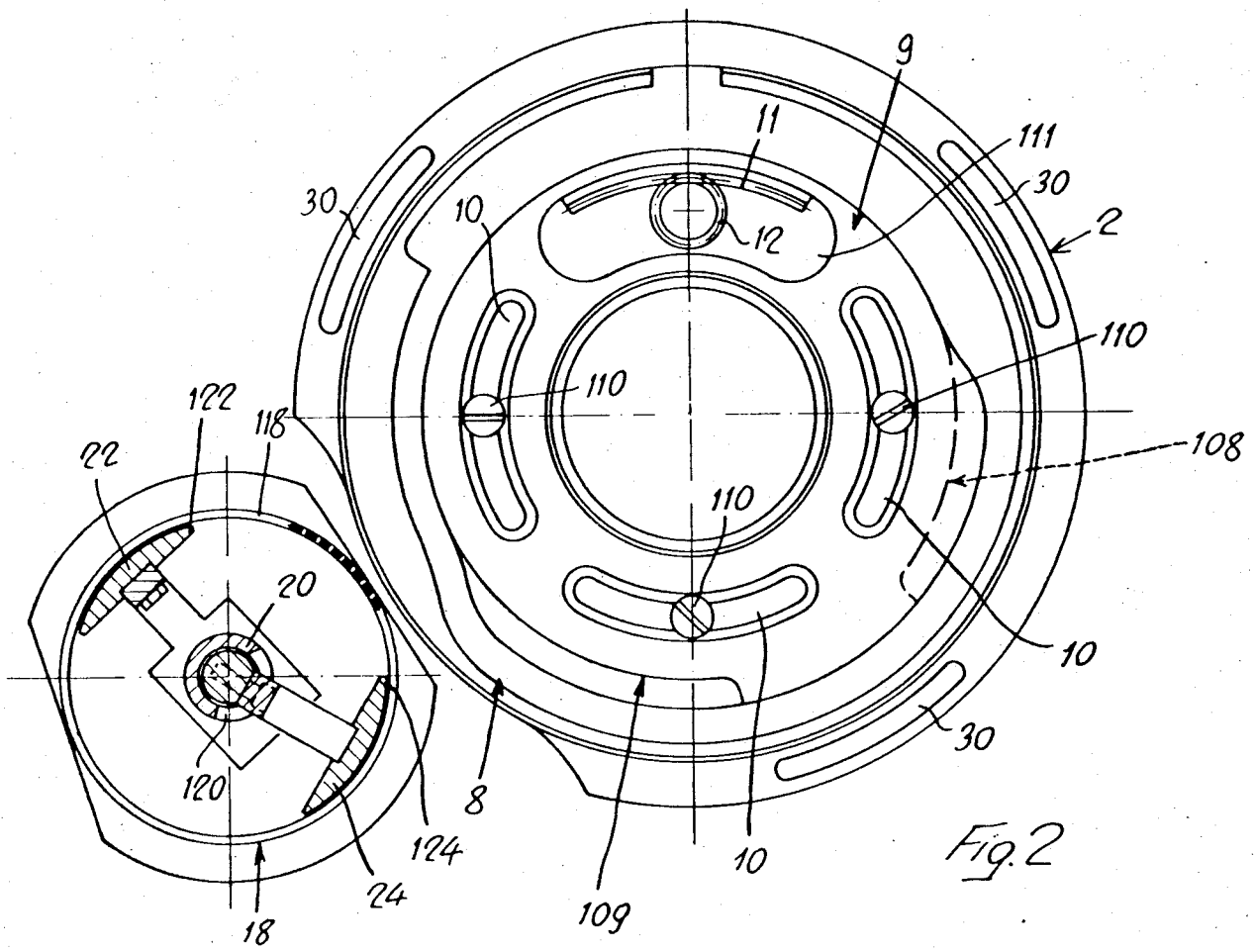
FIG. 2 is a partial schematic top view of the retractable points drum, and the respective suction detaching cylinder in transverse section.

In order to obtain the displacement of the retractable points 3 of drum 2, on each side of this drum 2 there are provided two fixed coaxial cams 8 and 9 supported by the drum-holding frame 31 and cooperating with the extremities 106 of the point-carrying bars 6. The external fixed cams 8 cause the movement of the point-carrying bars 6 inward, while the internal fixed cams 9 cause the movement of the point-carrying bars outward. As shown in details in FIG. 2, cams 9 have an undercutting 109 in the zone of the active sector of cams 8, while these latter present an undercutting 108 in the zone of the active sector of cams 9.

The degree of projection of the retractable points 3 of the peripheral surface of drum 2 is preferably adjustable, to adjust the depth of penetration of points 3 into the cut tobacco present in the vertical duct 1 and, consequently, to vary the quantity of cut tobacco taken in the time unit by drum 2 with retractable points 3. In the described embodiment, such adjustment of the degree of projection of the retractable points 3 is obtained by varying the relative angular position between the two pairs of cams 8 and 9. In the illustrated embodiment the angular position of the internal cams 9 is varied, with respect to the external cams. For this purpose, each internal cam 9 is mounted in the drum-holding frame 31 in a limitedly revolving way about the revolving axis of the pointed drum 2 and is guided by means of screws 110 screwed into the drum-holding frame 31 and inserted into concentric arched slots of cam 9. Moreover, each cam 9 has, in the zone of its arched slot 111, a sector gear 11, into which a control pinion 12 engages.

The shafts 112 of the two pinions 12 are coupled, each one through a train of gears 16, 15, 14 to a common adjustment shaft 114 which passes, coaxially, through the tubular shaft 5 and is supported, at its extremities, into the drum-holding frame 31. The adjustment shaft 114 can be hand-rotated by using a knob 13 at its extremity.

The drum holding frame 31 is fixed to walls 101 of the vertical duct 1 through slots 30 concentric to the rotation shaft of the same drum 2 which allow the angular position of drum 2 with retractable points 3 to be varied integrally with the respective pairs of control cams 8, 9 with respect to the inner outlet of duct 1 which supplies the cut tobacco.

Drum 2 with retractable points 3 cooperates with a suction detaching cylinder 18 the tubular skirt 118 of which, made by any material permeable to air, e.g. pierced metal sheet, is fixed by means of its head flange 218 to a tubular shaft 21. This shaft 21 is mounted, rotatably, inside frame 33, through bearings 34 and it can be driven, for instance, by wheel gear 35, or similar equipment, in the direction of arrow F1.

The detaching cylinder 18 closes the upper outlet of a suction duct 19.

The suction generated in such duct 19 operates actively through the skirt 118 of the detaching cylinder 18 peripherally on the opposite side of the said detaching cylinder 18 where there are the drum 2 with retractable points 2 and a projecting roller 27 with peripheral paddles 127.

At the interior of the detaching cylinder 18 there extends, axially, a tube 20 which passes, coaxially, through the tubular shaft 21 and is rotatably mounted, inside frame 33 and in the detaching cylinder 18 by means of bearings 36. On this tube 20 there is fixed a shutter plate 22 which avoids suction through skirt 118. The edge 122 of this shutter plate located upstream with reference to the direction of rotation F1 of the detaching cylinder 18, defines the end of a suction sector formed by skirt 118 of the detaching cylinder 18 and directed towards the retractable points of drum 2. A further shutter plate 24 which avoids suction through skirt 118 of the detaching cylinder 18 is fixed, through an opening 120 in the tube 20 to a shaft 23 rotatably mounted inside tube 20 itself. The edge 124 of the shutter plate 24 downstream when referred to the rotation sense F1 of the detaching cylinder 18, defines the starting point for the above mentioned suction sector of skirt 118, directed toward the drum 2 with retractable points 3.

The width of the suction sector formed between the two shutter plates 22 and 24 and the angular position of such sector on skirt 118 of the detaching cylinder 18 with reference to drum 2 can be varied and adjusted by angularly displacing the two shutter plates 22 and 24 through knobs 25 and 26 fixed, respectively, on tube 20 and on shaft 23.

Around drum 2 with retractable points 3 a fixed holding panel 17 is provided which extends from the lower outlet of the vertical duct 1 which supplies the cut-tobacco up to the pneumatic suction detaching cylinder 18.

The above-described distributing device of cut tobacco for cigarette-making machines, operates as follows:

Cams 8 and 9 are made and adjusted in such a way that the projection of points 3 of drum 2 is the maximum one permitted or preset at the lower outlet of the feeding duct 1 and in correspondence with the major portion of the subsequent peripheral fixed panel 17.

Drum 2 takes and thus holds with its projecting points 3 a layer of cut tobacco and carries same toward the pneumatic detaching cylinder 18. By getting nearer to detaching cylinder 18, points 3 of drum 2 are retracted progressively, and they result to be completely retracted in drum 2 in correspondence with the area of shortest distance between drum 2 and the detaching cylinder 18.

Thereby the veil of cut tobacco taken by drum 2 is released by the points and is taken by the pneumatic detaching cylinder 18, to which it adheres and is held by simple suction, without undergoing practically any degradation. The peripheral speed of the suction detaching cylinder 18 is, preferably, much higher than the one of drum 2 with retractable points 3 to obtain a large homogeneity of the veil of cut tobacco transferred from drum 2 to coating 118 of the detaching cylinder 18.

After the end of the suction sector defined between the two shutter plates 22, 24 the cut tobacco transported peripherally by skirt 118 of the pneumatic detaching cylinder 18, is engaged by the paddles 127 of the projecting roller 27 and projected between a plate 28 and a suction roller 29 in a direction that is substantially parallel and tangent to plate 28 itself, for further treatment and utilization in the cigarette-making machine.

I claim:

1. A cut-tobacco distributing device for cigarette-making machines, comprising:

a rotating detaching cylinder which is constructed as a pneumatic suction cylinder without points; and a rotating pointed drum disposed adjacent the detaching cylinder to receive the cut tobacco and transfer it to the detaching cylinder, the pointed drum including a plurality of points, means mounting the points for movement between an extended position and a substantially retracted position, and control means for extending and retracting the points, the control means temporarily moving the points to their substantially retracted position when the points are in the region of the detaching cylinder.

2. A distributing device according to claim 1, wherein the control means comprises adjustable means for varying the maximum extension of the points.

3. A distributing device according to claim 2 wherein the adjustable means comprises at least one pair of fixed cams coaxial to the drum and cooperating with the means mounting the points, at least one of the cams of the at least one pair being angularly adjustable within predetermined limits and having a sector gear, and an adjustment pinion which meshes with the sector gear, the adjustment pinion being one of manually and automatically rotatable.

4. A distributing device according to claim 1, wherein the means mounting the points comprises point-carrying bars to which the points are secured, and means for mounting the bars so that they extend parallelly to the axis of the drum and are movably guided in the same, in one of a radial direction and an inclined direction with respect to the radial one, and wherein the control means comprises cam means and elastic means for moving the bars.

5. A distributing device according to claim 4, wherein the bars have extremities and wherein the cam means comprises at least one pair of fixed cams coaxial to the drum and cooperating with the extremities of the point-carrying bars, one of said cams of the at least one pair promoting the inward displacement of the point-carrying bars while the other cam of the at least one pair causes the displacement of the point-carrying bars outwards.

6. A distributing device according to claim 5, wherein the control means further comprises means for displacing one cam of the at least one pair angularly with respect to the other cam of the at least one pair, to vary the maximum extension of the points from drum.

7. A distributing device according to claim 6 wherein at least one of the cams of the at least one pair can be angularly adjusted within predetermined limits and has a sector gear, and wherein the means for displacing one cam of the at least one pair comprises an adjustment pinion which meshes with the sector gear, the adjustment pinion being one of manually and automatically rotatable.

8. A distributing device according to claim 4 wherein the cam means comprises at least one pair of fixed cams coaxial to the drum and cooperating with the bars, at least one of the cams of the at least one pair being angularly adjustable within predetermined limits and having a sector gear, and an adjustment pinion which meshes with the sector gear, the adjustment pinion being one of manually and automatically rotatable.

9. A distributing device according to claim 5 wherein at least one of the cams of the at least one pair can be angularly adjusted within predetermined limits and has a sector gear, and wherein the control means further comprises an adjustment pinion which meshes with the sector gear, the adjustment pinion being one of manually and automatically rotatable.

10. A distributing device according to claim 1, wherein the control means comprises at least one pair of fixed cams coaxial to the drum and cooperating with the means mounting the points, at least one cam of the at least one pair being angularly adjustable within predetermined limits and having a sector gear, and an adjustment pinion which meshes with the sector gear, the adjustment pinion being one of manually and automatically rotatable.

11. A distributing device according to claim 1, wherein the detaching cylinder comprises a skirt which is permeable to air, two shutter plates, and means for mounting the shutter plates inside the detaching cylinder so that the shutter plates cooperate with the skirt and delimit a suction sector which is directed toward the drum.

12. A distributing device according to claim 11, wherein the means for mounting the shutter plates comprises means for adjustably holding at least one of the plates so that the plates can be angularly displaced, with respect to each other and to the skirt, in order to modify and adjust at least one of the amplitude and the angular position of the suction sector.

* * * * *